US012365510B2

(12) United States Patent
Sorbara et al.

(10) Patent No.: US 12,365,510 B2
(45) Date of Patent: Jul. 22, 2025

(54) SPOUT FOR A CONTAINER AND PACKAGE-SPOUT ASSEMBLY

(71) Applicant: Tetra Laval Holdings & Finance S.A., Pully (CH)

(72) Inventors: Angelo Sorbara, Rubiera (IT); Rocco De Paola, Modena (IT); Franco Cani, Asti (IT); Tiziano Viani, Bibbiano (IT); Martina Linguiti, Soliera Modena (IT); Luca Gori, Bologna (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 157 days.

(21) Appl. No.: 17/789,805

(22) PCT Filed: Feb. 11, 2021

(86) PCT No.: PCT/EP2021/053304
§ 371 (c)(1),
(2) Date: Jun. 29, 2022

(87) PCT Pub. No.: WO2021/165131
PCT Pub. Date: Aug. 26, 2021

(65) Prior Publication Data

US 2023/0044435 A1 Feb. 9, 2023

(30) Foreign Application Priority Data

Feb. 19, 2020 (EP) ..... 20158237

(51) Int. Cl.
*B65D 5/74* (2006.01)
*B65D 43/16* (2006.01)
(Continued)

(52) U.S. Cl.
CPC ..... *B65D 5/748* (2013.01); *B65D 43/163* (2013.01); *B65D 43/164* (2013.01)

(58) Field of Classification Search
CPC ..... B65D 1/265; B65D 2251/10; B65D 2251/1008; B65D 2251/105;
(Continued)

(56) References Cited

U.S. PATENT DOCUMENTS 8,794,460 B2 * 8/2014 Druitt ..... B65D 50/061 220/345.2
2012/0024815 A1 2/2012 Kwon
(Continued)

FOREIGN PATENT DOCUMENTS

DE 102007057863 A1 * 6/2009 ..... B65D 5/748
DE 102010028518 A1 * 11/2011 ..... B65D 5/748
(Continued)

OTHER PUBLICATIONS

International Search Report mailed May 11, 2021, for priority International Patent Application No. PCT/EP2021/053304.
(Continued)

*Primary Examiner* — Anthony D Stashick
*Assistant Examiner* — Marcos Javier Rodriguez Molina
(74) *Attorney, Agent, or Firm* — BUCHANAN INGERSOLL & ROONEY PC

(57) ABSTRACT

A spout for a container filled with a pourable product. The spout comprises at least a collar having a pouring outlet configured to allow an out-pouring of the pourable product and a lid assembly having a coupling ring rotatably arranged around the collar and a lid hinged to the coupling ring and angularly movable around a respective hinge axis. The lid is controllable between at least a closing configuration, an open configuration and an intermediate configuration. The spout comprises an interaction device partially associated to the collar and partially associated to the lid. The interaction device is configured such that control of the lid from the closing configuration to the intermediate configuration is
(Continued)

possible only by rotation of the lid and the coupling ring around a rotation axis and such that control of the lid from the intermediate configuration to the closing configuration is possible by a sole angular movement of the lid around the hinge axis from the intermediate angular position to the closing angular position.

20 Claims, 12 Drawing Sheets

(51) Int. Cl.
*B65D 41/04* (2006.01)
*B65D 41/34* (2006.01)
*B65D 55/16* (2006.01)

(58) Field of Classification Search
CPC ..... B65D 2251/1058; B65D 25/40; B65D 2543/0062; B65D 2575/586; B65D 2583/049; B65D 3/26; B65D 35/42; B65D 39/08; B65D 41/04; B65D 41/0471; B65D 41/06; B65D 41/34; B65D 41/3423; B65D 43/0225; B65D 43/16; B65D 43/164; B65D 43/169; B65D 43/24; B65D 47/0842; B65D 47/122; B65D 47/14; B65D 47/142; B65D 47/2012; B65D 47/244; B65D 47/261; B65D 47/266; B65D 50/041; B65D 50/046; B65D 50/048; B65D 50/061; B65D 51/2807; B65D 55/022; B65D 55/12; B65D 55/16; B65D 55/165; B65D 77/2072; B65D 85/72; B65D 1/0207; B65D 1/023; B65D 1/0276; B65D 1/0238; B65D 1/14; B65D 1/20; B65D 1/22; B65D 1/36; B65D 11/02; B65D 11/06; B65D 11/10; B65D 13/02; B65D 17/00; B65D 17/401; B65D 17/4012; B65D 17/464; B65D 17/506; B65D 17/521; B65D 19/0012; B65D 19/0081; B65D 19/06; B65D 19/40; B65D 21/0219; B65D 21/022; B65D 21/0231; B65D 21/0233; B65D 21/086; B65D 2203/12; B65D 2205/00; B65D 2215/02; B65D 2215/04; B65D 2231/022; B65D 2251/0012; B65D 2251/0021; B65D 2251/0025; B65D 2251/0056; B65D 2251/0071; B65D 2251/0078; B65D 2251/0081; B65D 2251/0093; B65D 2251/0096; B65D 2251/07; B65D 2251/09; B65D 2251/205; B65D 2255/06; B65D 2255/20; B65D 23/003; B65D 23/02; B65D 23/102; B65D 23/14; B65D 2313/00; B65D 2401/10; B65D 2401/15; B65D 2401/30; B65D 2401/35; B65D 2401/50; B65D 2401/55; B65D 25/10; B65D 25/14; B65D 25/24; B65D 25/2888; B65D 25/42; B65D 25/465; B65D 2501/0081; B65D 2501/009; B65D 2517/0014; B65D 2517/0017; B65D 2517/0043; B65D 2517/0046; B65D 2517/0056; B65D 2517/0062; B65D 2517/0079; B65D 2517/0082; B65D 2517/0098; B65D 2517/5091; B65D 2519/00044; B65D 2519/00104; B65D 2519/00114; B65D 2519/00288; B65D 2519/00308; B65D 2519/00333; B65D 2519/00338; B65D 2519/00378; B65D 2519/00432; B65D 2519/00512; B65D 2519/00532; B65D 2519/00562; B65D 2519/00572; B65D 2519/00582; B65D 2519/00656; B65D 2519/00661; B65D 2519/00805; B65D 2519/00875; B65D 2519/0096; B65D 2519/00985; B65D 2543/00027; B65D 2543/00046; B65D 2543/00222; B65D 2543/00277; B65D 2543/00296; B65D 2543/00351; B65D 2543/00416; B65D 2543/00425; B65D 2543/00435; B65D 2543/0049; B65D 2543/00509; B65D 2543/00518; B65D 2543/00527; B65D 2543/00537; B65D 2543/00546; B65D 2543/00555; B65D 2543/00564; B65D 2543/00574; B65D 2543/00629; B65D 2543/00657; B65D 2543/00685; B65D 2543/00694; B65D 2543/00731; B65D 2543/0074; B65D 2543/00768; B65D 2543/00796; B65D 2543/00805; B65D 2543/00814; B65D 2543/00842; B65D 2543/00851; B65D 2543/00888; B65D 2543/00898; B65D 2543/00944; B65D 2543/00972; B65D 2543/0099; B65D 2547/066; B65D 2571/00055; B65D 2575/3227; B65D 2577/205; B65D 2577/2083; B65D 2577/2091; B65D 2585/681; B65D 2585/6815; B65D 2585/6855; B65D 2585/6857; B65D 2585/6867; B65D 2588/125; B65D 2590/023; B65D 2590/542; B65D 2590/666; B65D 3/10; B65D 33/00; B65D 33/1641; B65D 35/02; B65D 35/12; B65D 35/14; B65D 35/24; B65D 35/28; B65D 35/30; B65D 35/36; B65D 35/38; B65D 35/44; B65D 35/56; B65D 39/00; B65D 39/0017; B65D 39/0023; B65D 39/0029; B65D 39/0035; B65D 39/0041; B65D 39/0052; B65D 39/04; B65D 39/082; B65D 39/084; B65D 39/088; B65D 39/10; B65D 39/12; B65D 39/16; B65D 41/00; B65D 41/005; B65D 41/02; B65D 41/0414; B65D 41/0421; B65D 41/0428; B65D 41/0435; B65D 41/0442; B65D 41/045; B65D 41/0457; B65D 41/0485; B65D 41/0492; B65D 41/065; B65D 41/08; B65D 41/086; B65D 41/12; B65D 41/14; B65D 41/16; B65D 41/165; B65D 41/17; B65D 41/18; B65D 41/185; B65D 41/20; B65D 41/26; B65D 41/28; B65D 41/32; B65D 41/3404; B65D 41/3409; B65D 41/3414; B65D 41/3419; B65D 41/3428; B65D 41/3433; B65D 41/3438; B65D 41/3442; B65D 41/3447; B65D 41/3452; B65D 41/36; B65D 41/365; B65D 41/38; B65D 41/46; B65D 41/47; B65D 41/58; B65D 41/62; B65D 43/02; B65D 43/0204; B65D 43/0208; B65D 43/021; B65D 43/0212; B65D 43/0218; B65D 43/0222; B65D 43/0229; B65D 43/0231; B65D 43/0277; B65D 43/14; B65D 43/162; B65D 43/163; B65D 43/166; B65D 43/168; B65D 43/18; B65D 43/22; B65D 43/26; B65D 43/265;

B65D 43/267; B65D 45/00; B65D 45/02; B65D 45/025; B65D 45/06; B65D 45/14; B65D 45/16; B65D 45/20; B65D 45/24; B65D 45/28; B65D 45/30; B65D 45/305; B65D 45/32; B65D 45/322; B65D 45/325; B65D 45/34; B65D 45/345; B65D 47/00; B65D 47/04; B65D 47/043; B65D 47/046; B65D 47/06; B65D 47/061; B65D 47/063; B65D 47/065; B65D 47/068; B65D 47/08; B65D 47/0804; B65D 47/0809; B65D 47/0814; B65D 47/0823; B65D 47/0828; B65D 47/0833; B65D 47/0838; B65D 47/0852; B65D 47/0861; B65D 47/0871; B65D 47/0876; B65D 47/0885; B65D 47/0895; B65D 47/10; B65D 47/103; B65D 47/106; B65D 47/12; B65D 47/123; B65D 47/125; B65D 47/128; B65D 47/143; B65D 47/145; B65D 47/148; B65D 47/18; B65D 47/20; B65D 47/2006; B65D 47/2018; B65D 47/2031; B65D 47/2037; B65D 47/2081; B65D 47/2087; B65D 47/24; B65D 47/241; B65D 47/242; B65D 47/243; B65D 47/248; B65D 47/249; B65D 47/26; B65D 47/263; B65D 47/265; B65D 47/283; B65D 47/268; B65D 47/286; B65D 47/30; B65D 47/305; B65D 47/32; B65D 47/36; B65D 47/40; B65D 49/04; B65D 47/029; B65D 47/42; B65D 5/00; B65D 5/029; B65D 5/065; B65D 5/4208; B65D 5/50; B65D 5/56; B65D 5/722; B65D 5/74; B65D 5/746; B65D 5/747; B65D 5/748; B65D 5/749; B65D 50/00; B65D 50/04; B65D 50/043; B65D 50/045; B65D 50/06; B65D 50/062; B65D 50/065; B65D 50/066; B65D 50/067; B65D 50/068; B65D 51/00; B65D 51/002; B65D 51/007; B65D 51/14; B65D 51/145; B65D 51/1644; B65D 51/1661; B65D 51/1666; B65D 51/1672; B65D 51/1677; B65D 51/1683; B65D 51/1688; B65D 51/1694; B65D 51/18; B65D 51/185; B65D 51/20; B65D 51/22; B65D 51/222; B65D 51/223; B65D 51/225; B65D 51/226; B65D 51/227; B65D 51/228; B65D 51/24; B65D 51/242; B65D 51/243; B65D 51/245; B65D 51/246; B65D 51/249; B65D 51/28; B65D 51/2821; B65D 51/2835; B65D 51/2842; B65D 51/285; B65D 51/2864; B65D 51/2885; B65D 51/2892; B65D 51/32; B65D 53/02; B65D 53/04; B65D 53/08; B65D 55/02; B65D 55/024; B65D 55/026; B65D 55/063; B65D 55/08; B65D 55/0863; B65D 55/089; B65D 55/145; B65D 59/06; B65D 65/38; B65D 7/00; B65D 7/04; B65D 7/045; B65D 7/24; B65D 7/32; B65D 7/42; B65D 71/0096; B65D 71/50; B65D 75/008; B65D 75/326; B65D 75/50; B65D 75/56; B65D 75/566; B65D 75/5811; B65D 75/5822; B65D 75/585; B65D 75/5861; B65D 75/5866; B65D 75/5872; B65D 75/5877; B65D 75/5883; B65D 77/02; B65D 77/0406; B65D 77/048; B65D 77/0486; B65D 77/0493; B65D 77/06; B65D 77/065; B65D 77/067; B65D 77/283; B65D 77/30; B65D 79/0087; B65D 2203/00; B65D 2203/02; B65D 2401/25; B65D 2401/40; B65D 2401/45; B65D 25/00; B65D 25/04; B65D 25/08; B65D 25/16; B65D 25/20; B65D 25/22; B65D 25/34; B65D 25/38; B65D 25/48; B65D 25/52; B65D 25/54; B65D 2501/24675; B65D 2517/0011; B65D 2517/002; B65D 2517/0041; B65D 2517/0049; B65D 2517/0073; B65D 2517/0074; B65D 2517/0092; B65D 2517/0097; B65D 2519/00019; B65D 2519/00034; B65D 2519/00069; B65D 2519/00079; B65D 2519/00273; B65D 2519/00318; B65D 2519/00323; B65D 2519/00373; B65D 2519/00502; B65D 2519/00567; B65D 2519/00641; B65D 2519/0082; B65D 2519/0093; B65D 2519/0094; B65D 2519/0099; B65D 2525/28; B65D 2539/005; B65D 2543/00092; B65D 2543/00194; B65D 81/02; B65D 81/05; B65D 81/051; B65D 81/052; B65D 81/055; B65D 81/058; B65D 81/07; B65D 81/075; B65D 81/09; B65D 81/113; B65D 81/2038; B65D 81/2053; B65D 81/22; B65D 81/24; B65D 81/264; B65D 81/32; B65D 81/3211; B65D 81/3216; B65D 81/3222; B65D 81/3227; B65D 81/325; B65D 81/3261; B65D 81/3283; B65D 81/3453; B65D 81/3484; B65D 81/3881; B65D 81/3886; B65D 83/00; B65D 83/0005; B65D 83/0011; B65D 83/0016; B65D 83/0022; B65D 83/0027; B65D 83/0033; B65D 83/0038; B65D 83/005; B65D 83/0055; B65D 83/0072; B65D 83/0077; B65D 83/02; B65D 83/04; B65D 83/0409; B65D 83/0454; B65D 83/0481; B65D 83/049; B65D 83/06; B65D 83/0805; B65D 83/14; B65D 83/16; B65D 83/20; B65D 83/201; B65D 83/203; B65D 83/205; B65D 83/206; B65D 83/207; B65D 8/22; B65D 83/24; B65D 83/262; B65D 83/267; B65D 83/285; B65D 83/30; B65D 83/303; B65D 83/306; B65D 83/34; B65D 83/38; B65D 83/384; B65D 83/386; B65D 83/40; B65D 83/425; B65D 83/44; B65D 83/46; B65D 83/48; B65D 83/54; B65D 83/56; B65D 83/62; B65D 83/64; B65D 83/68; B65D 83/682; B65D 83/685; B65D 83/75; B65D 83/757; B65D 85/00; B65D 85/04; B65D 85/10; B65D 85/20; B65D 85/24; B65D 85/38; B65D 85/42; B65D 85/48; B65D 85/64; B65D 85/672; B65D 85/68; B65D 85/70; B65D 85/73; B65D 85/80; B65D 85/8043; B65D 85/8046; B65D 85/8061; B65D 85/84; B65D 88/10; B65D 88/125; B65D 88/126; B65D 88/28; B65D 88/38; B65D 88/706; B65D 90/046; B65D 90/10; B65D 90/48; B65D 90/545; B65D

90/582; B65D 90/626; B65D 2205/02; B65D 2213/02; B65D 2231/004; B65D 2231/005; B65D 2251/0015; B65D 2251/0018; B65D 19/0028; B65D 19/44; B65D 21/0211; B65D 21/0224; B65D 21/0228; B65D 11/24; B65D 17/4014; B65D 1/0246; B65D 1/0253; B65D 1/26; B65D 2251/0028; B65D 2251/0031; B65D 2251/0075; B65D 2251/0087; B65D 2251/009; B65D 2251/023; B65D 2251/065; B65D 2251/1041; B65D 2251/1066; B65D 2251/20; B65D 23/00; B65D 23/001; B65D 23/06; B65D 23/0885; B65D 2313/04; B65D 2401/00; B01D 2201/4015; B01D 2265/022; B05C 17/00509; B21B 2203/30; B23B 2240/04; B23B 31/113; B23B 31/268; B23C 2240/04; B29C 2045/675; B29C 49/1202; B29C 49/0438; B25G 3/16; B60B 23/04; B60B 25/16; B60Q 1/2634; B65H 75/2272

USPC ..... 220/836; 222/556; 215/272, 293, 317, 215/318, 322

See application file for complete search history.

(56) References Cited

U.S. PATENT DOCUMENTS

2012/0285921 A1 11/2012 Kwon

2013/0043260 A1 2/2013 Barron

FOREIGN PATENT DOCUMENTS

| | | | | | |
|---|---|---|---|---|---|
| DE | 202019106933 | U1 | | 1/2020 | |
| DE | 202019106993 | U1 | * | 3/2020 | ..... B65D 5/74 |
| EA | 018556 | B1 | | 8/2013 | |
| EP | 0947433 | A1 | * | 10/1999 | ..... B65D 5/748 |
| EP | 2508432 | A1 | | 10/2012 | |
| KR | 102049730 | B1 | | 11/2019 | |
| WO | 9614249 | A2 | | 5/1996 | |
| WO | WO1996014249 | A2 | * | 5/1996 | ..... B65D 5/749 |
| WO | 2009048273 | A2 | | 4/2009 | |
| WO | WO-2011138069 | A1 | * | 11/2011 | ..... B65D 5/748 |

OTHER PUBLICATIONS

Office Action/Search Report (Decision to Grant) issued on Jun. 6, 2024, in corresponding Russian Patent Application No. 2022123838 and English translation of the Office Action/Search Report. (22 pages).

Extended European Search Report issued on Apr. 29, 2024, in corresponding European Patent Application No. 24150844.9. (7 pages).

Office Action/Search Report (The First Office Action) issued on Aug. 16, 2024, in corresponding Chinese Patent Application No. 202180009666.1 and English translation of the Office Action/Search Report. (21 pages).

* cited by examiner

SPOUT FOR A CONTAINER AND PACKAGE-SPOUT ASSEMBLY

TECHNICAL FIELD

The present invention relates to a spout for a container, in particular for a sealed package, filled with a pourable product, even more particular filled with a pourable food product.

The present invention also relates to a package-spout assembly having a sealed package filled with a pourable product, even more particular filled with a pourable food product, and a spout arranged on the sealed package.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages, in particular a respective sealed main body of the packages formed from the packaging material, comprises a designated pour opening surface area, which allows the outpouring of the pourable product from the package. Typically, the designated pour opening surface area is covered by a separation membrane, which isolates the inside of the package from the outer environment and which is to be opened or to be removed or to be ruptured or to be cut or to be pierced prior to the first outpouring of the pourable product so as to allow for the outpouring of the pourable product. It is also known to arrange a spout having a collar and a lid on the main body about the designated pour opening surface area so as to control the outpouring of the pourable product. The collar has a pouring outlet so as to allow for a controlled outpouring of the pourable product from the package and the lid allows to selectively close and open the pouring outlet.

Some of the known spouts comprise an opening assembly so as to pierce and/or open the pour opening surface area in a controlled manner.

A drawback of these kind of spouts is seen in that the decoupling of the lid from the collar means a complete detachment of the lid from the collar, which may possibly lead to an unwanted losing of the lid or to a littering of the lid by an irresponsible user.

Thus, there is a need felt in the sector to further improve the spouts and/or the package-spout assemblies.

DISCLOSURE OF INVENTION

It is therefore an object of the present invention to provide in a straightforward and low-cost manner an improved spout for a container, in particular a sealed package, filled with a pourable product, even more particular filled with a pourable food product.

In particular, it is an object of the present invention to provide in a straightforward and low-cost manner an improved spout for a container, in particular a sealed package, filled with a pourable product, even more particular filled with a pourable food product, which improves the user experience by coming along with an easy and intuitive use.

It is a further object of the present invention to provide in a straightforward and low-cost manner a package-spout assembly having a sealed package filled with a pourable product, in particular filled with a pourable food product, and a spout.

It is a further object of the present invention to provide in a straightforward and low-cost manner a package-spout assembly having a sealed package filled with a pourable product, in particular filled with a pourable food product, and a spout, which improves the user experience by coming along with an easy and intuitive use.

According to the present invention, there is provided a spout according to the independent claim.

Further advantageous embodiments of the spout are specified in the respective dependent claims.

According to the present invention, there is also provided a package-spout assembly according to claim 15.

BRIEF DESCRIPTION OF THE DRAWINGS

Three non-limiting embodiments of the present invention will be described by way of example with reference to the accompanying drawings, in which.

BEST MODES FOR CARRYING OUT THE INVENTION

Number 1 indicates as a whole a container-spout assembly, in particular a package-spout assembly, comprising:

- a container, in particular a sealed package 2, even more particular a sealed carton package, being filled with a pourable product, in particular a pourable food product, and in particular having a designated pour opening surface area (not shown and known as such); and
- a spout 3, in particular a plastic spout, fitted to the container, in particular to package 2 about the designated pour opening surface area.

Package 2 is obtained from a packaging material, in particular being in the form of a web, and having a multilayer structure (not shown). The packaging material comprises at least a layer of fibrous material, such as e.g. a paper or cardboard, and at least two layers of heat-seal plastic material, e.g. polyethylene, interposing the layer of fibrous material in between one another. One of these two layers of heat-seal plastic material defining the inner face of package 2 contacting the pourable product.

Preferably but not necessarily, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the packaging material also comprises a further layer of heat-seal plastic material being interposed between the layer of gas- and light-barrier material and the layer of fibrous material.

According to a preferred non-limiting embodiment, spout(s) 3 is(are) applied to package(s) 2 prior, during or after the formation, filling and sealing of package(s) 2 by means of a molding process and/or adhesive bonding and/or ultrasonic bonding.

Alternatively, spout(s) 3 can be applied onto the packaging material prior to arranging the packaging material within or during advancement of the packaging material within a packaging machine for forming, filling and sealing packages 2 from the packaging material.

Figure 1:
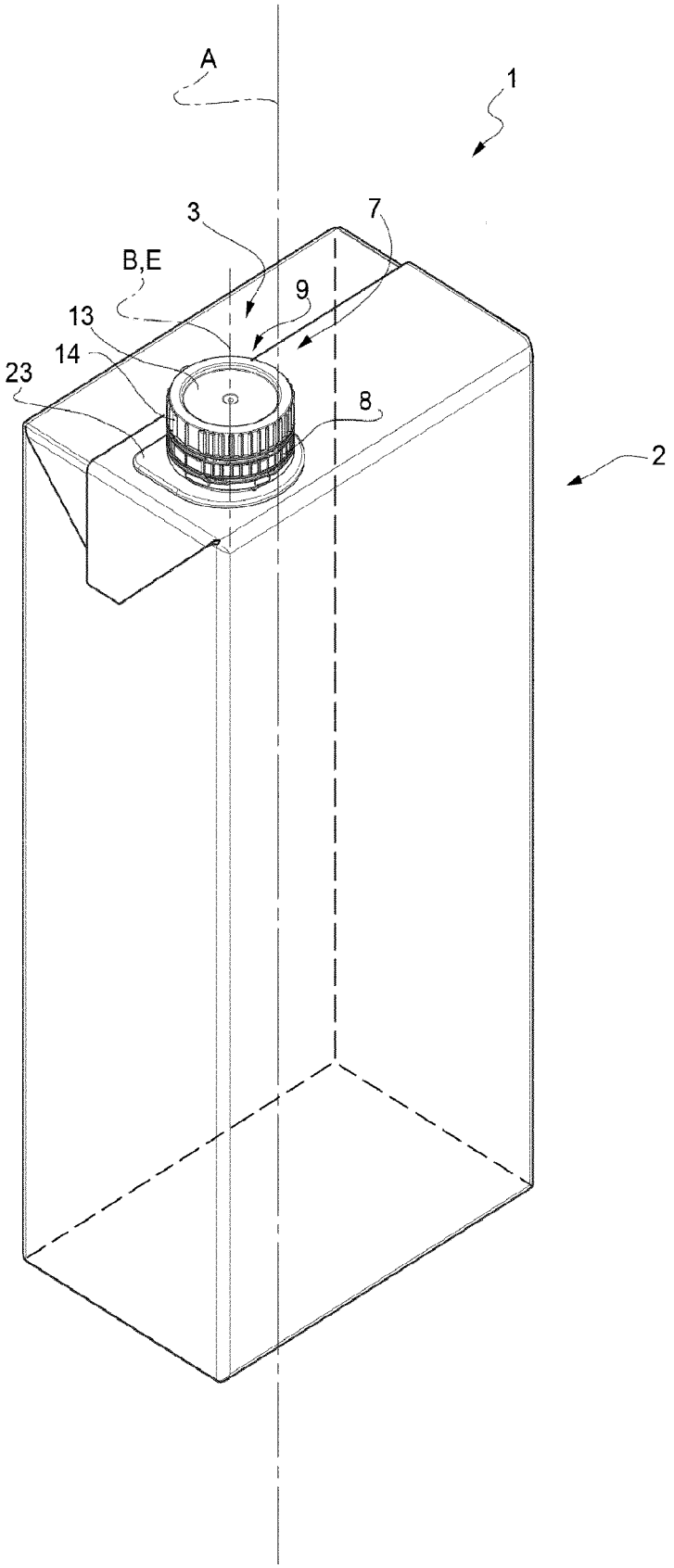
FIG. 1 is a schematic perspective view of a package-spout assembly having a spout according to a first embodiment of the present invention arranged in a first configuration, with parts removed for clarity.
Figure 2:
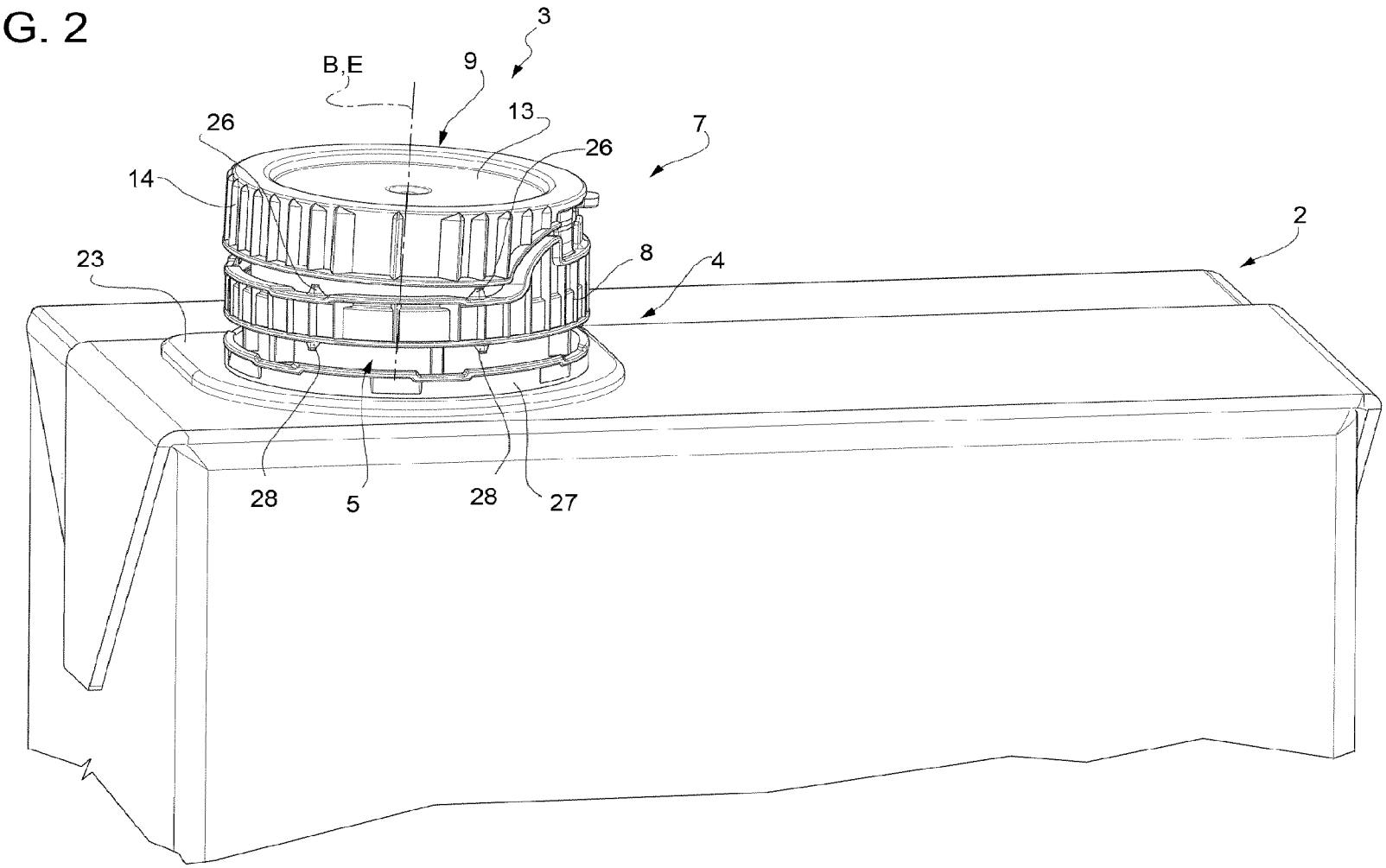
FIG. 2 is a schematic and enlarged perspective view of the package-spout assembly of FIG. 1 with the spout arranged in a second configuration, with parts removed for clarity.
Figure 3:
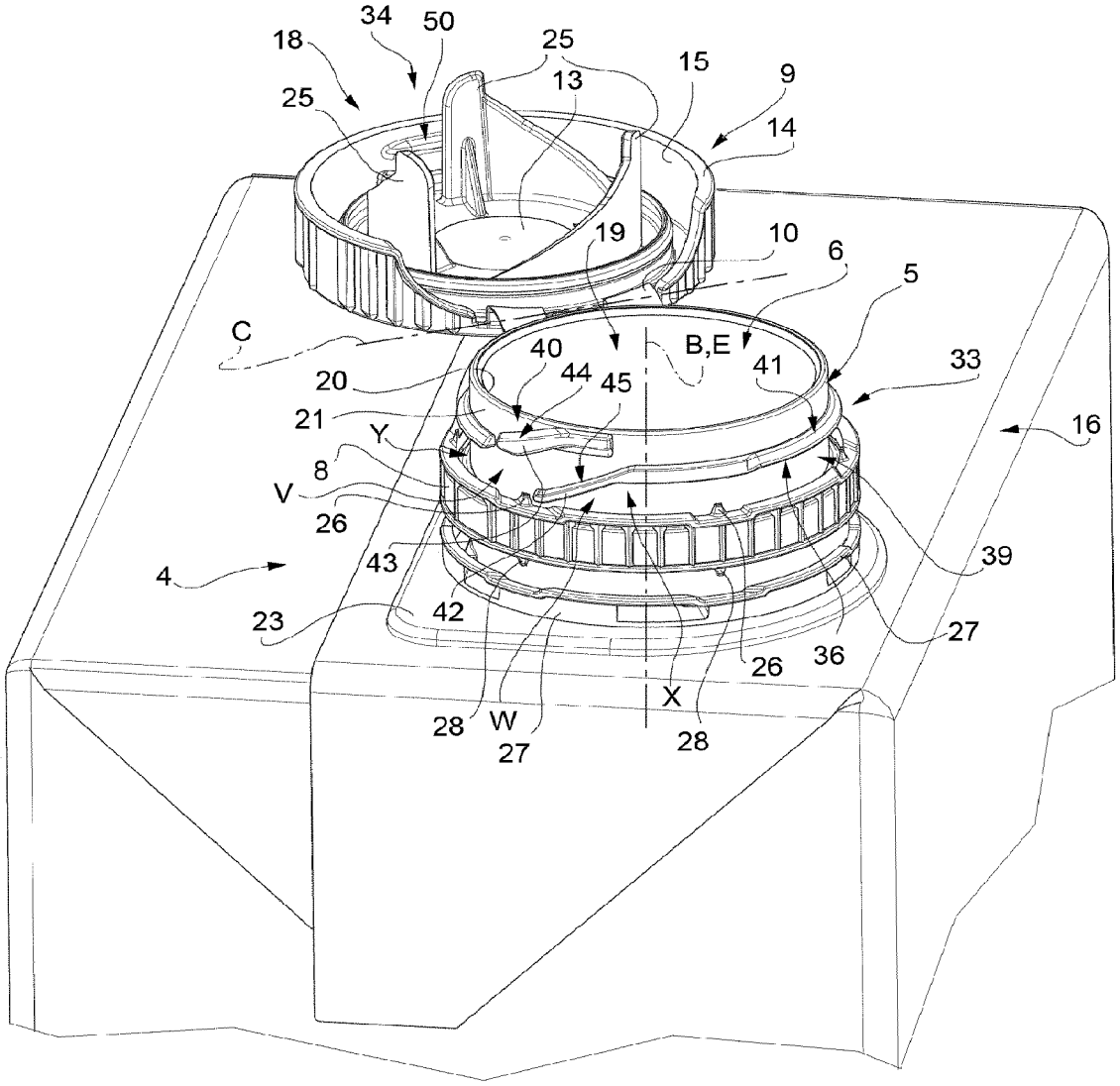
FIG. 3 is a schematic and enlarged perspective view of the package-spout assembly of FIG. 1 with the spout arranged in a third configuration, with parts removed for clarity.
Figure 4:
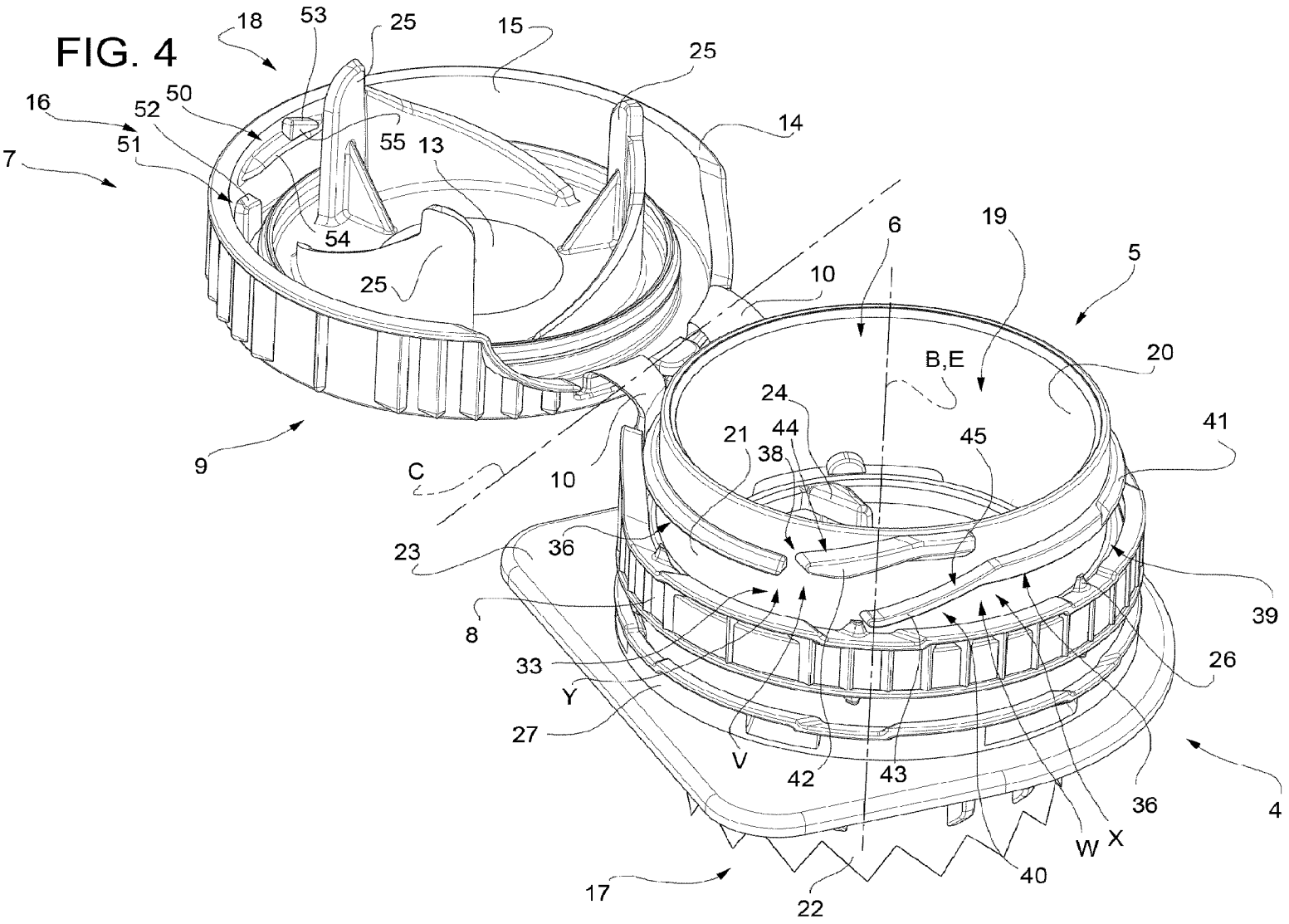
FIG. 4 is an enlarged view of the spout of FIGS. 1 to 3 and arranged in the third configuration, with parts removed for clarity.
Figure 5:
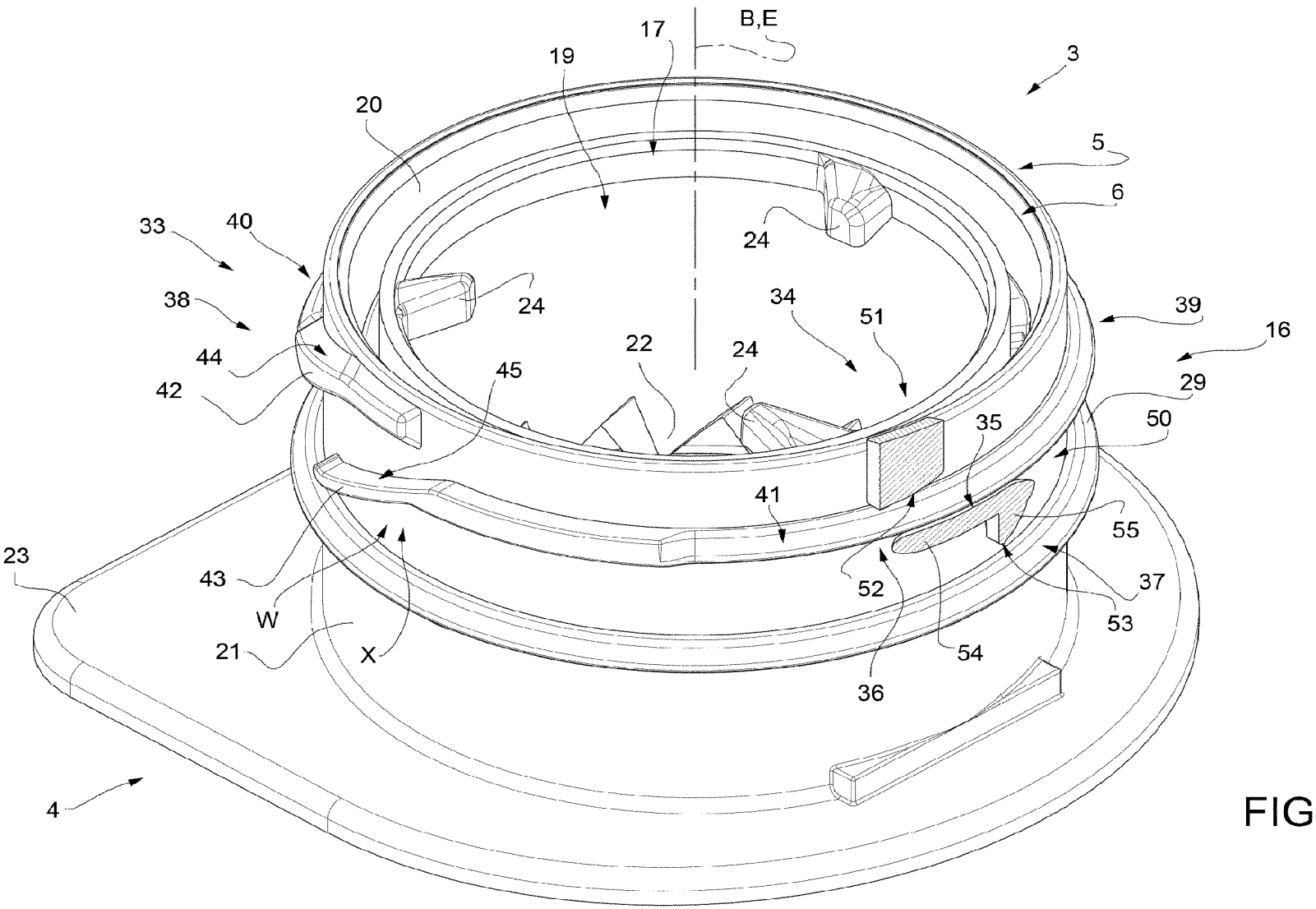
FIG. 5 is an enlarged view of some details of the spout of FIGS. 1 to 3 arranged in the first configuration, with parts removed for clarity.

With particular reference to FIG. 1, package 2 extends along a longitudinal axis A.

Preferentially but not necessarily, package 2 is parallelepiped-shaped.

In particular, the designated pour opening surface area of package 2 is configured to be at least partially (non-reversibly) opened and/or ruptured and/or cut and/or pierced so as to allow the out-pouring of the pourable product from package 2, in particular through spout 3. Even more particular, the pour opening surface area is configured to allow the out-pouring of the pourable product after its loss of integrity and to protect the pourable product from the outer environment prior to its cutting and/or opening and/or rupturing and/or piercing.

According to a preferred non-limiting embodiment, the pour opening surface area comprises a separation membrane (not shown and known as such) configured to be ruptured and/or opened and/or cut and/or pierced. In particular, the separation membrane separates in the area of, in particular at, the designated pour opening surface area the inside of package 2 from the outside of package 2. Preferentially but not necessarily, the separation membrane comprises a gas- and light-barrier material, e.g. aluminum foil or ethylene vinyl alcohol (EVOH) film.

According to a preferred non-limiting embodiment, the separation membrane is defined by a portion of the packaging material, in particular a portion of the layers of the packaging material being different from the layer of fibrous material.

With particular reference to FIGS. 1 to 7, spout 3 comprises at least:

- a base frame 4 configured to be fitted and/or being fitted about the designated pour opening surface area of package 2 and having a collar 5 being provided with at least a pouring outlet 6, configured to allow for an (controlled) outflow of the pourable product from package-spout assembly 1 and/or package 2; and
- a lid assembly 7 coupled and/or couplable to base frame 4, in particular collar 5, and being configured to at least selectively close or open pouring outlet 6.

In particular, collar 5 extends along a longitudinal axis B (and away from package 2), preferentially but not necessarily parallel to longitudinal axis A.

In particular, longitudinal axis B defines (is equal to) a central axis of collar 5 and/or pouring outlet 6.

Preferentially, collar 5 and pouring outlet 6 present a (substantially) circular cross-sectional profile, in particular with respect to a cross-sectional plane perpendicular to longitudinal axis B.

Advantageously, lid assembly 7 comprises:

- a coupling ring 8 rotatably arranged around collar 5, in particular such that coupling ring 8 is inseparable from collar 5; and
- a lid 9 hinged to coupling ring 8 and angularly movable around a respective hinge axis C, in particular being transversal, even more particular orthogonal, to longitudinal axis A and/or longitudinal axis B.

In particular, lid assembly 7 comprises a coupling element 10 configured to hinge lid 9 to coupling ring 8 and defining hinge axis C.

Advantageously, lid 9 is controllable between at least:

- a closing configuration (see FIG. 1) in which lid 9 is in a closing angular position with respect to hinge axis C and in which lid 9 is configured to cover and/or covers pouring outlet 6, in particular for impeding an outflow of the pourable product from package-spout assembly 1 and/or package 2;
- an open configuration (see FIG. 3) in which lid 9 is in an open angular position with respect to hinge axis C and in which lid 9 is configured to be and/or is detached from pouring outlet 6; and
- an intermediate configuration (see FIG. 2) in which lid 9 is in an intermediate angular position with respect to hinge axis C, the intermediate angular position being interposed between the closing angular position and the open angular position.

In particular, in use, control of lid 9 from the closing configuration to the open configuration requires at first control from the closing configuration to the intermediate configuration and then from the intermediate configuration to the open configuration. In other words, in use, control of lid 9 from the closing angular position to the open angular position requires at first control of lid 9 from the closing angular position to the intermediate angular position and then to the open angular position.

Preferentially, lid 9 comprises:

a top portion 13 configured to cover pouring outlet 6 with lid 9 being in the closing angular position; and a side wall 14 protruding from top portion 13 and configured to at least partially surround collar 5 with lid 9 being controlled in the closing angular position.

In particular, and with lid 9 being in the closing angular position, top portion 13 is transversal, in particular perpendicular, to longitudinal axis B and side wall 14 is (substantially) parallel to longitudinal axis B.

According to some possible non-limiting embodiments, lid 9 is, in particular top portion 13 and/or side wall 14 are, coupled to collar 5 when lid 9 is, in use, in the closing angular position (and in the intermediate angular position).

Preferentially, lid 9 comprises an inner surface 15, in particular inner surface 15 faces collar 5 with lid 9 being in the closing angular position (and intermediate angular position). In particular, top portion 13 and side wall 14 carry inner surface 15.

Advantageously, spout 3 comprises an interaction device 16 partially associated to (and/or connect to and/or carried by) collar 5 and partially associated to (and/or connect to and/or carried by) lid 7 and being configured such that control of lid 9 from the closing configuration to the intermediate configuration (in other words from the closing angular position to the intermediate angular position) is possible only by rotation of lid 9 and coupling ring 8 around a (common) rotation axis E, in particular parallel, even more particular coaxial, to longitudinal axis B, and such that control of lid 9 from the intermediate configuration to the closing angular configuration (in other words, from the intermediate angular position to the closing angular position) is at least possible by a sole angular movement of lid 9 around hinge axis C from the intermediate angular position to the closing angular position.

Preferentially, control of lid 9 from the intermediate angular position to the closing angular position is selectively possible by a sole angular movement of lid 9 around hinge axis C from the intermediate angular position to the closing angular position and by rotation of lid 9 and coupling ring 8 around rotation axis E.

It should be noted that according to such a non-limiting embodiment a user can freely choose whether to control lid 9 by the sole angular movement around hinge axis C or whether to induce the control of lid 9 from the intermediate angular position to the closing angular position by rotation of lid 9 around rotation axis E. It should be further noted that also a combination of both means of controlling lid 9 from the intermediate angular position to the closing angular position is possible.

According to some preferred non-limiting embodiments, spout 3 also comprises:

a (ring-shaped) cutter 17 moveably coupled to base frame 4, in particular collar 5, and being configured to at least partially cut and/or rupture and/or open and/or pierce the designated pour opening surface area, in particular the separation membrane; and a control device 18 configured to interact with and to control cutter 17 between a rest position, in which cutter 17 is configured to be and/or is retracted from the designated pour opening surface area, and an operative position in which cutter 17 is configured to at least partially cut and/or rupture and/or open and/or pierce the designated pour opening surface area.

In particular, control device 18 is configured to control cutter 17 from the rest position to the operative position upon rotation of lid 9 and coupling ring 8 around rotation axis E. Even more particular, control device 18 is configured to control cutter 17 from the rest position to the operative position the first time lid 9 and coupling ring 8 are, in use, rotated around rotation axis E for moving lid 9 for the first time from the closing angular position to the intermediate angular position.

With particular reference to FIGS. 3 to 7, collar 5 delimits an inner space 19 within which cutter 17 is at least partially placed.

Preferentially, collar 5 has a circular cross-sectional shape with respect to a sectional plane being orthogonal to longitudinal axis B.

According to a preferred non-limiting embodiment, collar 5 comprises an inner surface 20 facing inner space 13 and an outer surface 21 being opposite to inner surface 15 (and inner space 19).

In particular, with lid 9 being in the closing angular position (or in the intermediate angular position) inner surface 15 faces outer surface 21.

According to some preferred non-limiting embodiments, cutter 17 is configured to at least translate, in particular to rotate and translate, during its movement from the rest position to the operative position.

Preferentially, cutter 17 comprises a cutting section 22 (arranged at and/or defining an axial end portion of cutter 17) configured to open and/or cut and/or rupture and/or pierce the designated pour opening surface area, in particular the separation membrane. Preferentially, cutting section 22 has (comprises) a serrated profile.

According to a preferred non-limiting embodiment, control device 18 comprises a cam group configured to guide movement of cutter 17 from the rest position to the operative position.

Preferentially, the cam group comprises a cam profile and at least one, preferentially a plurality of, guiding element(s) configured to interact with the cam profile. In particular, the cam profile and the guiding element(s) cooperate in such a manner that cutter 17 executes, in use, a rototranslatory movement when moving from the rest position to the operative position.

Preferentially, the cam profile is associated and/or connected and/or integral to cutter 17 and the guiding element(s) is/are connected and/or associated and/or integral to base frame 4, in particular to collar 5, even more particular to inner surface 19.

With particular reference to FIGS. 3 to 7, base frame 4 further comprises a coupling base 23 configured to couple and/or to connect and/or coupling and/or connecting spout 3 to package 2. In particular, coupling base 23 carries collar 5.

Preferentially, coupling base 23 is configured to be fixed and/or is fixed to an outer surface of package 2, in particular in the area of, even more particular at, the designated pour opening surface area. In particular, at least a portion of coupling base 23 has substantially a plate-like configuration.

Preferentially but not necessarily, collar 5 extends from coupling base 23 along, in particular parallel to, longitudinal axis B.

With particular reference to FIGS. 4 to 7, control device 18 comprises:

a plurality of interaction elements 24 connected to, in particular integral to, cutter 17; and a plurality of interaction members 25 connected to and/or coupled to lid 9 and each one being configured to interact with one respective interaction element 24.

In particular, each interaction member 25 is coupled and/or connected to lid 9 such that a rotation of lid 9 around rotation axis E leads also to a rotation of interaction members 25 around rotation axis E.

Preferentially, in use, the rotation of lid 9 and interaction members 25 around rotation axis E causes at least a translatory, preferentially a rototranslatory, movement of cutter 17 by means of the interaction between interaction members 25 and interaction elements 24 and the cooperation between the cam profile and the guiding element(s).

With particular reference to FIGS. 1 to 4, spout 3 also comprises a plurality of rupturable main coupling bridges 26 connecting coupling ring 8 and lid 9 to one another, in particular prior to the first time lid 9 is, in use, controlled from the closing angular position to the intermediate angular position. In particular, in use, during the first time of controlling lid 9 from the closing angular position to the intermediate angular position, main coupling bridges 26 irreversibly rupture. Even more particular, in use, main coupling bridges 26 rupture after control of cutter 17 from the rest position to the operative position.

With particular reference to FIGS. 1 to 4, spout 3 also comprises a tamper evidence ring 27 arranged around collar 5, and in particular between coupling base 23 and coupling ring 8. In particular, tamper evidence ring 27 is parallel to coupling ring 8 and is axially displaced from coupling ring 8.

In particular, spout 3 also comprises rupturable auxiliary coupling bridges 28 coupling tamper evidence ring 27 and coupling ring 8 to one another. Auxiliary coupling bridges 28 are configured to irreversibly rupture the first time a rotation of lid 9 and coupling ring 8 around rotation axis E is actuated. Preferentially, in use, auxiliary coupling bridges 28 rupture prior to movement of cutter 17 from the rest position to the operative position.

According to some preferred non-limiting embodiments, collar 5 comprises an interaction ring 29, in particular protruding from outer surface 21 and configured to interact with coupling ring 8. Preferentially, interaction ring 29 is configured to inseparably couple coupling ring 8 to collar 5 and to allow for rotation of coupling ring 8 around rotation axis E.

Advantageously and with particular reference to FIGS. 1 to 7, interaction device 16 comprises at least:

- a main interaction structure 33 associated to, in particular connected to and/or carried by, collar 5; and
- a main interaction unit 34 associated to, in particular connected to and/or carried by, lid 9 and configured to interact with main interaction structure 33.

In particular, interaction of main interaction unit 34 with main interaction structure 33 is such that, in use, movement of lid 9 from the closing angular position to the intermediate angular position requires rotation of lid 9 (and of coupling ring 8) around rotation axis E (i.e. the interaction between main interaction unit 34 and main interaction structure 33 does not allow a sole angular movement of lid 9 around hinge axis C for controlling lid 9 from the closing angular position to the intermediate angular position).

It should be noted that within the scope of the present description a sole angular movement of lid 9 around hinge axis C is an angular movement of lid 9 around hinge axis C that occurs while lid 9 remains angularly fixed with respect to rotation axis E. In other words, any angular movement of lid 9 around hinge axis C is a sole angular movement if lid 9 does not rotate around rotation axis E.

Preferentially, the interaction of main interaction structure 33 and main interaction unit 34 is such that the first time rotation of lid 9 around rotation axis E is actuated, angular movement of lid 9 around hinge axis C, in particular from the closing angular position to the intermediate angular position, is executed only after movement of cutter 17 from the rest position to the operative position.

Preferentially, main interaction unit 34 comprises:

- a first engagement surface 35 configured to abut against an abutment surface 36 of main interaction structure 33 so as to hinder an angular movement of lid 9 around hinge axis C, in particular from the closing angular position to the intermediate angular position; and
- a second engagement surface 37, in particular opposed to first engagement surface 35 and, configured to slide along a guiding surface 38 of main interaction structure 33 so as to control and/or actuate the angular movement of lid 9 around hinge axis C and from the closing angular position to the intermediate angular position.

In particular, the interaction of first engagement surface 35 and abutment surface 36 defines a locking mechanism of lid 9 in the closing angular position.

In particular, second engagement surface 37 and guiding surface 38 define a respective cam mechanism.

Preferentially (see FIGS. 5 and 6), first engagement surface 35 and second engagement surface 37 are configured to interact with respectively abutment surface 36 and guiding surface 38 in dependence of an angular position of lid 9 with respect to rotation axis E.

Preferentially, main interaction structure 33 and main interaction unit 34 are designed such that first engagement surface 35 and abutment surface 36 interact with one another (see FIG. 5), with lid 9 being positioned with respect to rotation axis E between a first angular lid position and a second angular lid position and such that second engagement surface 37 and guiding surface 38 interact with one another (see FIG. 6) with lid 9 being arranged with respect to rotation axis E between a third angular lid position and a fourth angular lid position. In particular, the third angular lid position and the fourth angular lid position are interposed between the second angular lid position and the first angular lid position.

Figure 6:
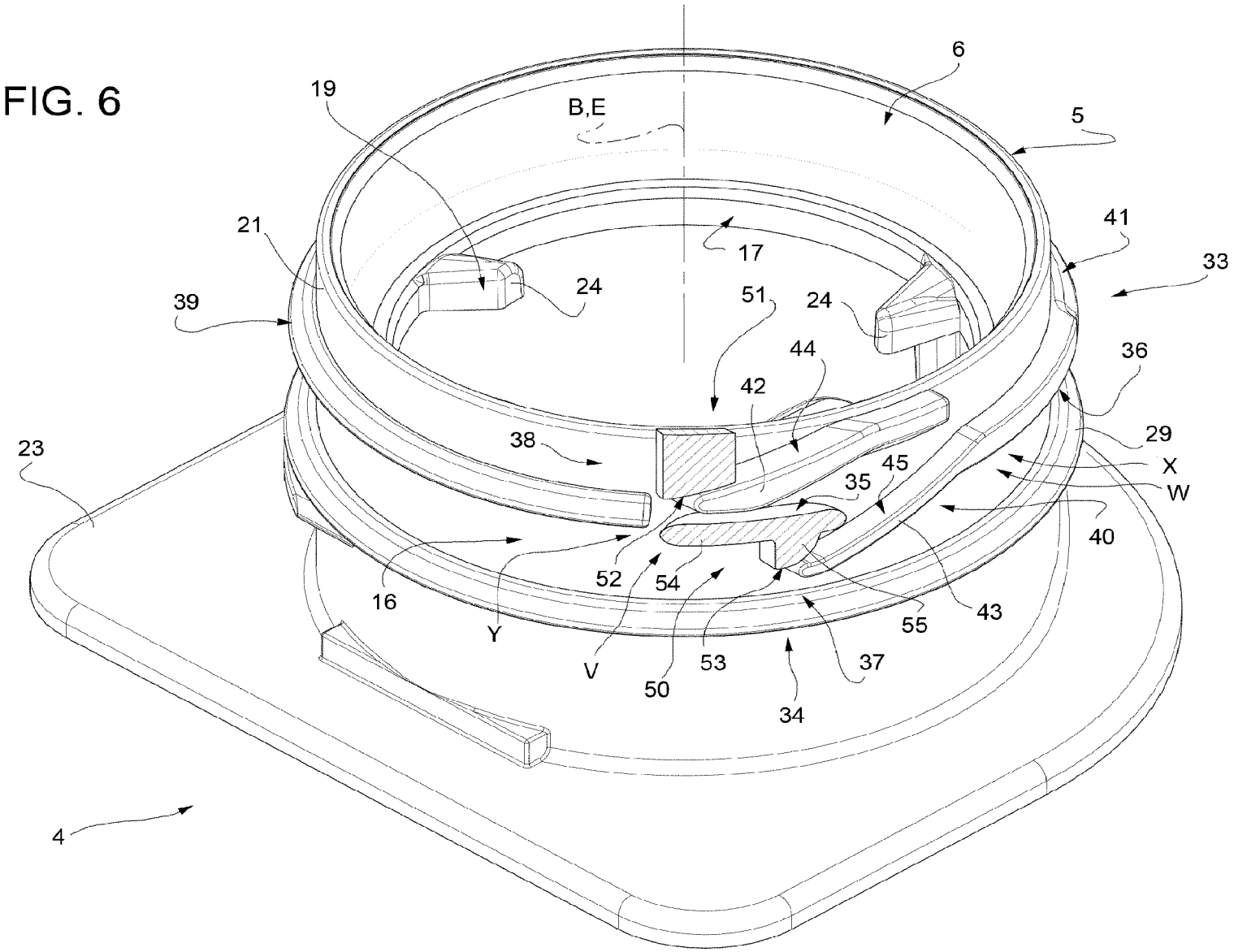
FIG. 6 is an enlarged view of some details of the spout of FIGS. 1 to 3 during control from the first configuration to the second configuration, with parts removed for clarity.
Figure 7:
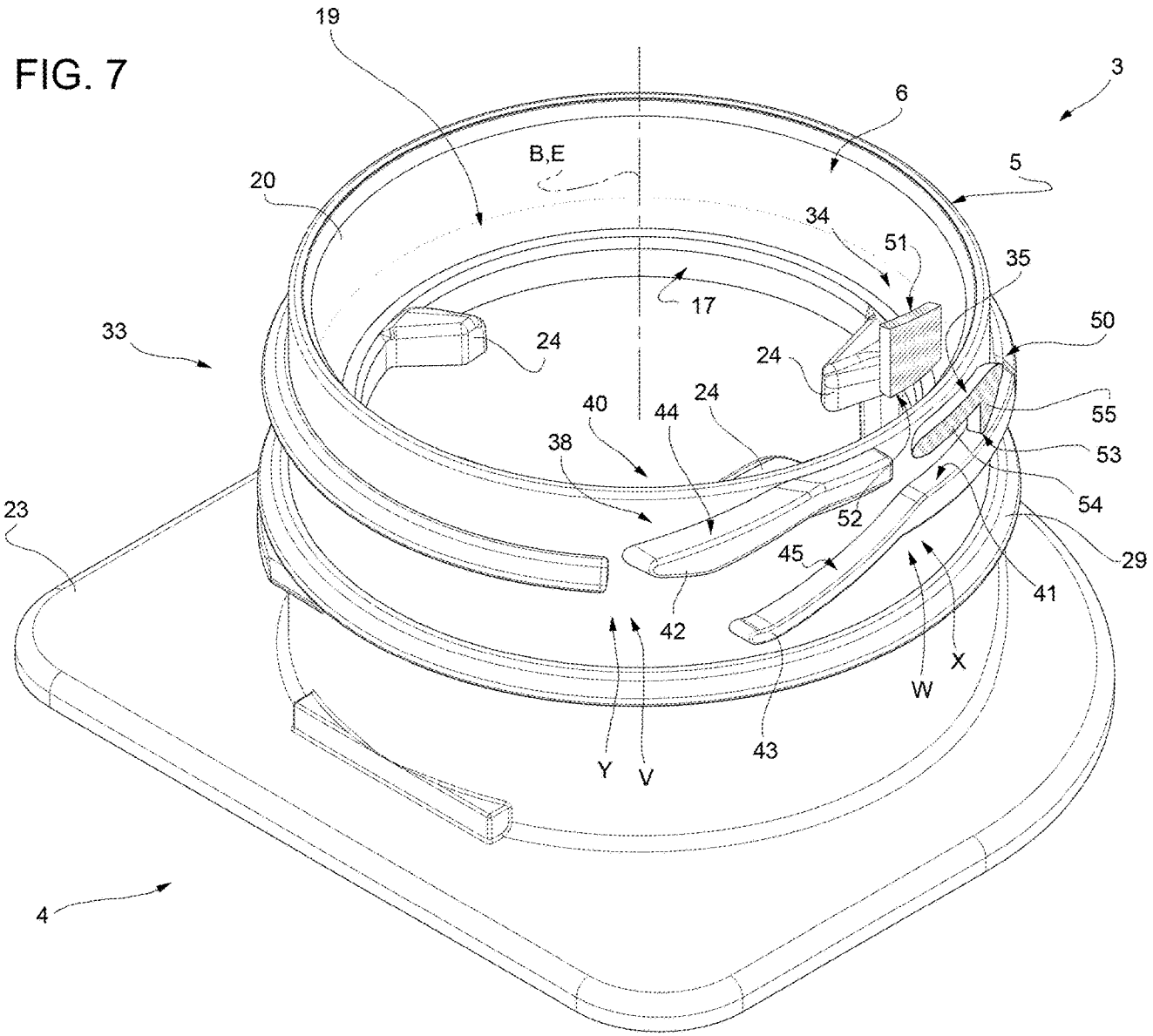
FIG. 7 is an enlarged view of some details of the spout of FIGS. 1 to 3 while being in a configuration between the first configuration and the second configuration, with parts removed for clarity.

In particular, with lid 9 being positioned with respect to rotation axis E between the first angular lid position and the second angular lid position, second engagement surface 37 and guiding surface 38 do not interact with one another (see FIG. 5) and with lid 9 being arranged with respect to rotation axis E between the third angular lid position and the fourth angular lid position first engagement surface 35 and abutment surface 36 do not interact with one another (see FIG. 6).

In other words, first engagement surface 35 is configured to abut against abutment surface 36 during a rotation of lid 9 around rotation axis E and with lid 9 being arranged between the first angular lid position and the second angular lid position with respect to rotation axis E and second engagement surface 37 is configured to slide on guiding surface 38 during a rotation of lid 9 around rotation axis E and with lid 9 being arranged between the third angular lid position and the fourth angular lid position.

In particular, it should be noted that with rotation of lid 9 around rotation axis E in a sense such that lid 9 rotates from the third angular lid position to the fourth angular lid position, the angular movement of lid 9 around hinge axis C is such to move lid 9 from the closing angular position to the intermediate angular position.

Furthermore, in use, during rotation of lid 9 from the fourth angular lid position to the third angular lid position it is possible to angularly move lid 9 around hinge axis C and from the intermediate angular position to the closing angular position.

In particular, main interaction unit 34 and main interaction structure 33 are also configured such that a sole angular movement around hinge axis C is possible for controlling lid 9 from the intermediate angular position to the closing angular position (during a re-closing operation). In such a case (i.e. during a re-closing operation), main interaction unit 34 can overcome main interaction structure 33 and once lid 9 is again in the closing angular position the reverse movement from the closing angular position to the intermediate angular position is prevented by the interaction between abutment surface 36 and first engagement surface 35.

According to some preferred non-limiting embodiments, main interaction structure 33 and main interaction unit 34 are also configured to retain lid 9 in the intermediate angular position after movement from the closing angular position to the intermediate angular position has been terminated.

Preferentially, guiding surface 38 is opposed to abutment surface 36.

In particular, while abutment surface 36 faces coupling base 23, guiding surface 38 faces away from coupling base 23.

According to some preferred non-limiting embodiments, main interaction structure 33 comprises:

- a locking portion 39, which extends between a first angular position X and a second angular position Y around longitudinal axis B and carries abutment surface 36; and
- a cam portion 40 carrying guiding surface 38 and extending between a third angular position V and a fourth angular position W around longitudinal axis B and interposed between second angular position Y and first angular position X.

According to some preferred non-limiting embodiments, cam portion 40 comprises at least a main cam portion 42, and in particular also an auxiliary cam portion 43 spaced apart from main cam portion 42. Preferentially, auxiliary cam portion 43 is angularly and axially spaced apart from main cam portion 42 with respect to rotation axis E.

Preferentially, main cam portion 42 carries (comprises) a main guiding portion 44 of guiding surface 38, and in particular auxiliary guiding portion 43 carries (comprises) an auxiliary guiding portion 45 of guiding surface 38.

In particular, locking portion 39 is (substantially) arc-shaped.

Preferentially, locking portion 39 and/or abutment surface 36 lie(s) within a first plane transversal, in particular perpendicular, to longitudinal axis B.

Preferentially, cam portion 40 and/or guiding surface 38 is inclined with respect to locking portion 39 and/or abutment surface 36. Even more preferentially, main cam portion 42 and main guiding portion 44, in particular also auxiliary cam portion 43 and auxiliary guiding portion 45, are inclined with respect to locking portion 39 and/or abutment surface 36.

In particular, main cam portion 42 and/or main guiding portion 44 lies within a second plane (distinct from the first plane) transversal to longitudinal axis B. Even more particular, auxiliary cam portion 43 and/or auxiliary guiding portion 45 lies within a third plane (distinct from the first plane and the second plane) spaced apart from the second plane.

Preferentially, the second plane, and in particular the third plane, is/are inclined with respect to the first plane.

In particular, in use, sliding of second engagement surface 37 on guiding surface 38 results in a force in a direction so as to distance lid 9 from coupling ring 8.

According to some preferred non-limiting embodiments, main interaction structure 33, in particular locking portion 39, comprises an auxiliary surface 41 (opposed to abutment surface 36 and) designed such to allow for lid 9 angularly moving from the intermediate angular position to the closing angular position by means of a sole angular movement of lid around hinge axis C. In particular, auxiliary surface 41 is designed such that main interaction unit 34 overcomes main interaction structure 33, in particular locking portion 39, during a sole angular movement of lid 9 around hinge axis C.

According to some preferred non-limiting embodiments, auxiliary surface 41 is also configured to interact with main interaction unit 34 with lid 9 being controlled in the intermediate angular position so as to retain lid 9 in the intermediate angular position.

According to some preferred non-limiting embodiments, main interaction structure 33, in particular locking portion 39 and cam portion 40, is/are connected to, in particular protrude from, outer surface 21.

According to some preferred non-limiting embodiments, main interaction unit 34 comprises at least a first interaction element 50 carrying (comprising) first engagement surface 35 and a second interaction element 51 carrying (comprising) at least a first portion 52 of second engagement surface 37. In particular, first portion 52 is configured to slide, in use, along main guiding portion 44 for controlling lid 9 from the closing angular position to the intermediate angular position.

According to some preferred non-limiting embodiments, first interaction element 50 carries (comprises) an interaction surface 53 opposite to first engagement surface 35 and being at least configured to engage auxiliary surface 41 with lid 9 being arranged in the intermediate angular position. In particular, engagement of interaction surface 53 with auxiliary surface 41 allows retaining lid 9 in the intermediate angular position after termination of movement of lid 9 from the closing angular position to the intermediate angular position (see FIG. 7).

According to the embodiment shown in FIGS. 1 to 7, interaction surface 53 also defines a second portion of second engagement surface 37. In particular, interaction surface 53 is configured to slide, in use, along auxiliary guiding portion 45, in use, promoting movement of lid 9 from the closing angular position to the intermediate angular position.

Preferentially, first interaction element 50 comprises a main wall 54 carrying (comprising) first engagement surface 35 and at least one tooth 55 protruding from main wall 54.

In particular, tooth 55 carries (comprises) interaction surface 53.

According to some preferred non-limiting embodiments, main interaction unit 34, in particular first interaction element 50 and second interaction element 51, is/are connected to, in particular protrude(s) from, inner surface 15, and in particular from side wall 14.

Preferentially, first interaction element 50 and second interaction element 51 are axially, and in particular also angularly, displaced from one another with respect to rotation axis E.

In use, outpouring of the pourable product from package-spout assembly 1, in particular package 2, requires liberating pouring outlet 6. This is done by controlling lid 9 from the closing configuration to the open configuration. Even more particular, at first lid 9 is controlled from the closing configuration to the intermediate configuration and then from the intermediate configuration to the open configuration.

In particular, movement of lid 9 from the closing configuration to the intermediate configuration requires rotation of lid 9 around rotation axis E. Even more particular, control from the intermediate configuration to the open configuration is to be done by the user by angularly moving lid 9 around hinge axis C.

Preferentially, the first time lid 9 is to be controlled from the closing configuration to the intermediate configuration cutter 17 is controlled from the rest position to the operative position for opening and/or rupturing and/or piercing the pour opening surface area, in particular the separation membrane. In particular, control of cutter 17 from the rest position to the operative position occurs prior to control of lid 9 from the closing configuration to the open configuration.

In more detail, during control of lid 9 from the closing configuration to the intermediate configuration the angular position of lid 9 with respect to hinge axis C is to be changed from the closing angular position to the intermediate angular position. As first engagement surface 35 abuts against abutment surface 36, lid 9 needs to be rotated around rotation axis E and from the first angular lid position to the fourth angular lid position and through the second angular lid position and the third angular lid position. Second engagement surface 37, slides on guiding surface 38 while lid 9 rotates around rotation axis E and angularly moves from the third angular lid position to the fourth angular lid position so as to actuate the angular movement around hinge axis C and from the closing angular position to the intermediate angular position.

In even more detail, while second engagement surface 37 slides on guiding surface 38 at least first portion 52 slides along main guiding portion 44, in particular also interaction surface 53 slides along auxiliary guiding portion 45.

Preferentially, after lid 9 has been controlled in the intermediate angular position, engagement of interaction surface 53 with auxiliary surface 41 guarantees that the angular position of lid 9 with respect to hinge axis C remains fixed.

When a user intends to newly impede the outflow of the pourable product, the user can control lid 9 again (during a re-closing operation) in the closing angular position. At first lid 9 needs to be controlled from the open angular position to the intermediate angular position, followed by controlling lid 9 from the intermediate angular position to the closing angular position. The latter can be obtained by a sole angular movement of lid 9 around hinge axis C, and in particularly alternatively by a rotation of lid 9 around rotation axis E.

Figure 8:
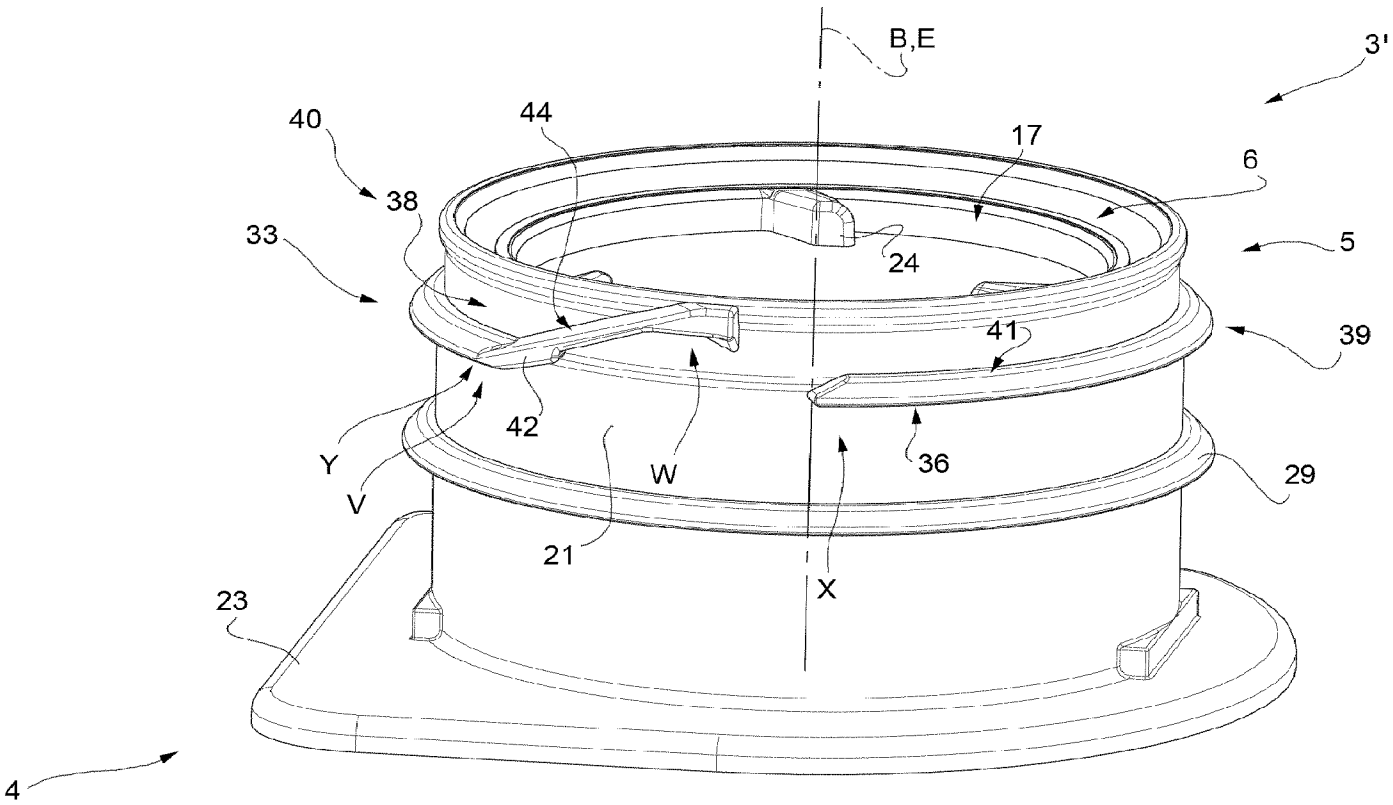
FIG. 8 is a perspective view of a detail of a spout according to a second embodiment of the present invention, with parts removed for clarity.
Figure 9:
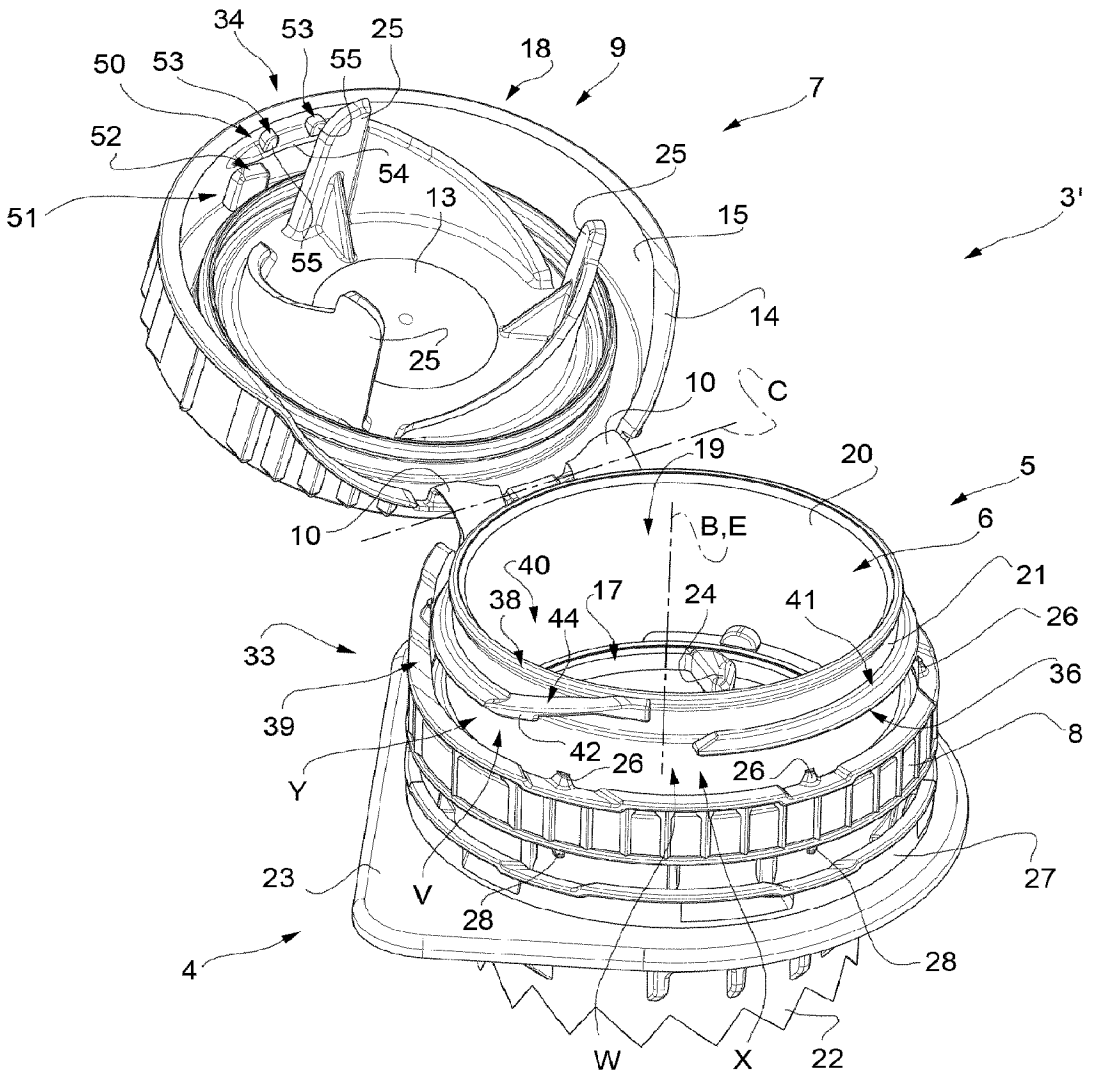
FIG. 9 is a perspective view of some further details of the spout according to the second embodiment of the present invention, with parts removed for clarity.
Figure 10:
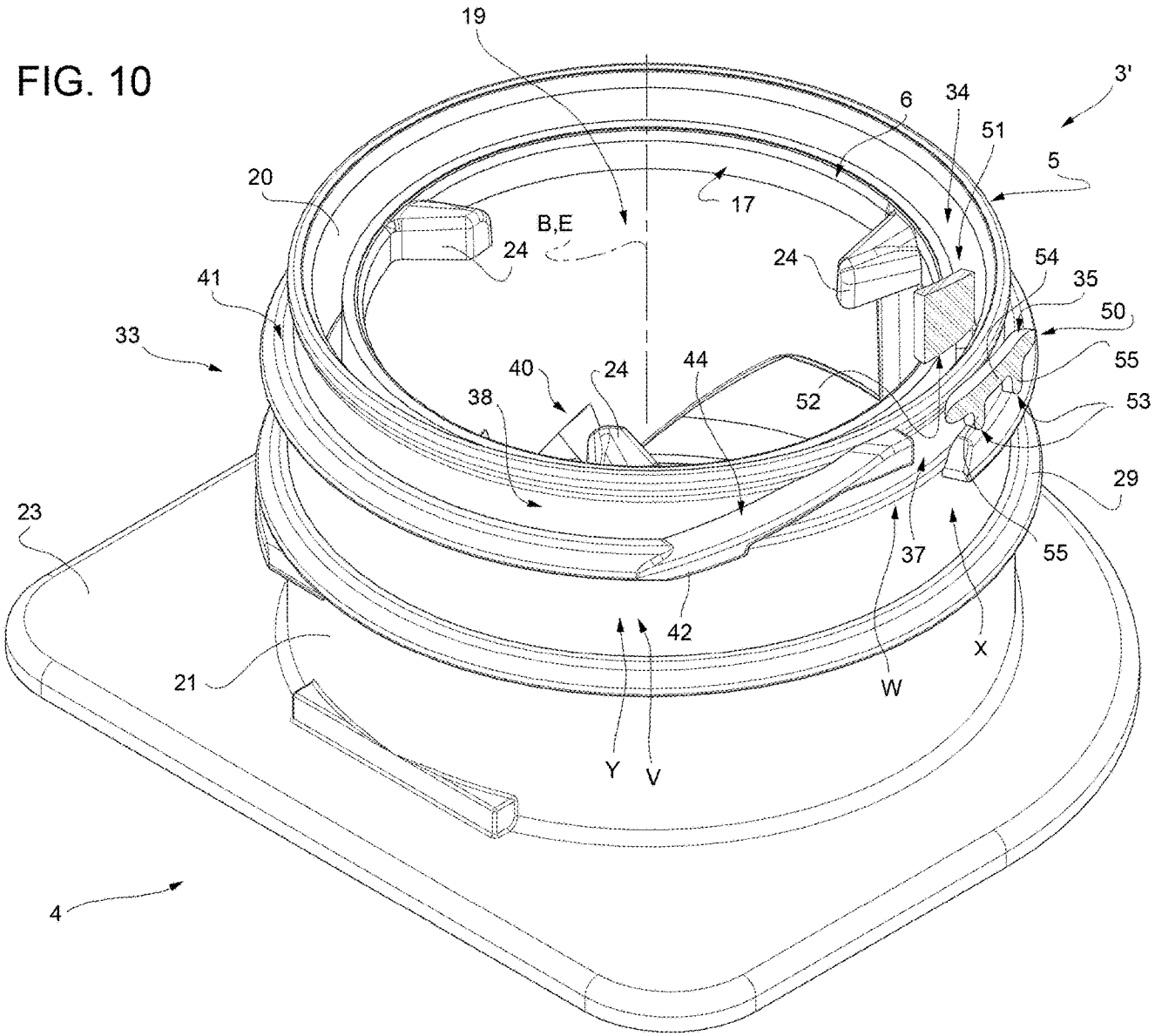
FIG. 10 is a further perspective of some more details of the spout according to the second embodiment of the present invention, with parts removed for clarity.

With reference to FIGS. 8 to 10, number 3' indicates an alternative embodiment of a spout according to the present invention; as spout 3' is similar to spout 3, the following description is limited to the differences between them, and using the same references, where possible, for identical or corresponding parts.

In particular, spout 3' differs from spout 3 in that cam portion 40 comprises main cam portion 42 and does not comprise auxiliary cam portion 43. Even more particular, interaction surface 53 is configured to engage auxiliary surface 41 but does not promote movement of lid 9 from the closing angular position to the intermediate angular position. In other words, only second interaction element 51 contributes to the angular movement of lid 9 from the closing angular position to the intermediate angular position.

Preferentially, spout 3' also differs from spout 3 in that first interaction element 50 comprises two teeth 55 protruding from main wall 54. In particular, teeth 55 being parallel to one another and each one carrying a respective portion of interaction surface 53.

Figure 11:
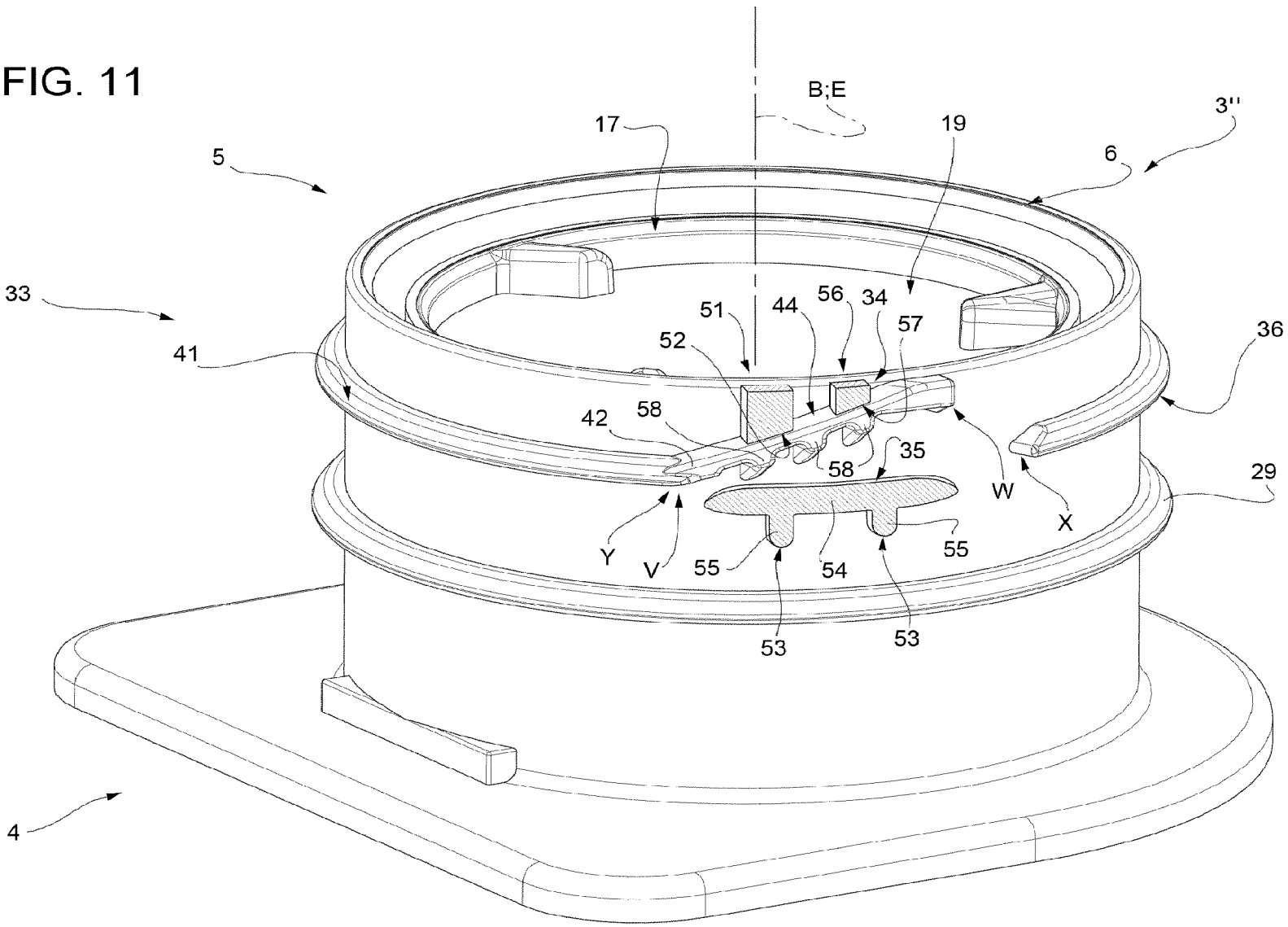
FIG. 11 is a perspective view of some details of a spout according to a third embodiment of the present invention and being in a first configuration, with parts removed for clarity.
Figure 12:
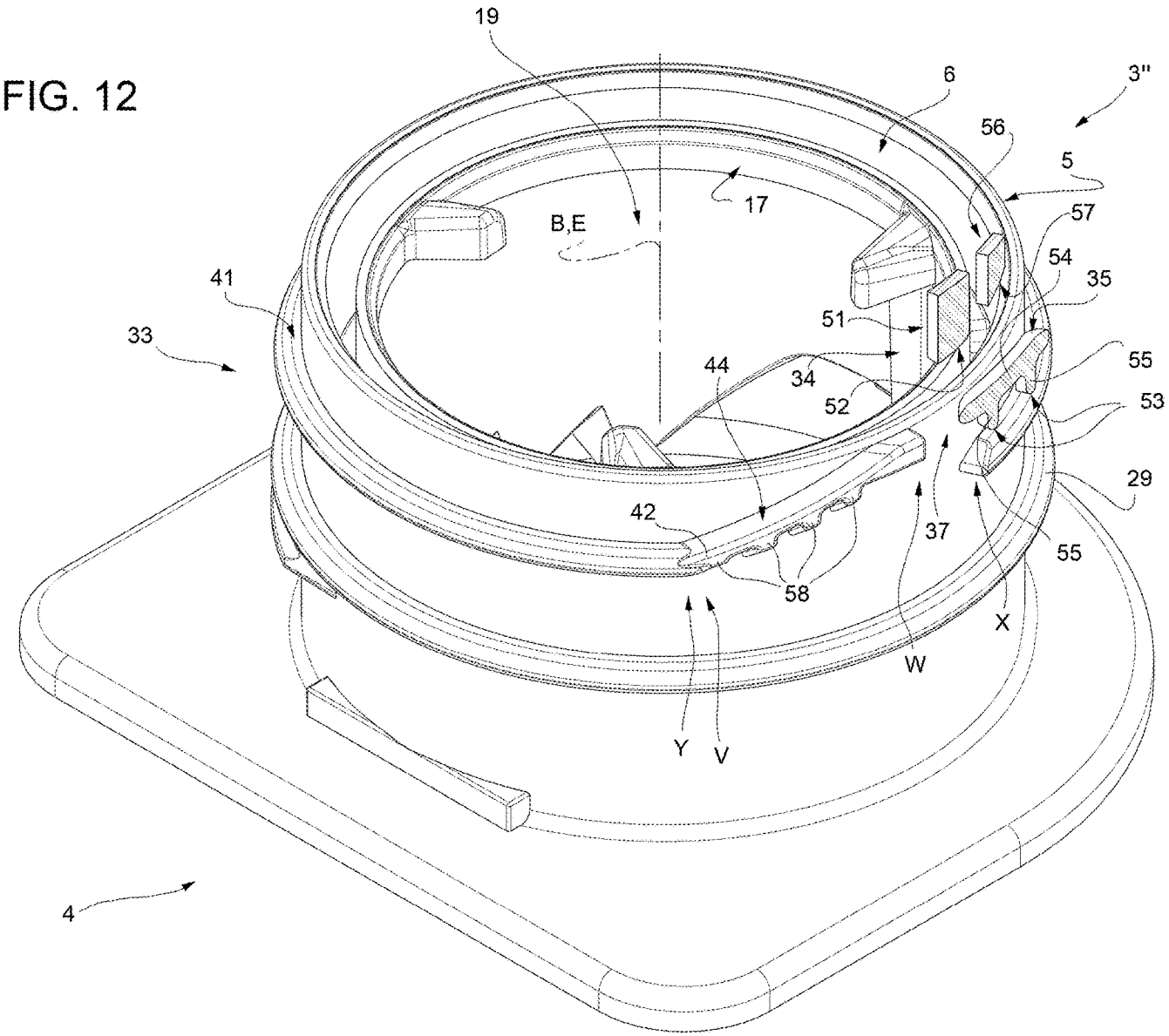
FIG. 12 is a perspective view of the spout of FIG. 11 being in a second configuration, with parts removed for clarity.

With reference to FIGS. 11 and 12, number 3" indicates a further alternative embodiment of a spout according to the present invention; as spout 3" is similar to spout 3', the following description is limited to the differences between them, and using the same references, where possible, for identical or corresponding parts.

In particular, spout 3" differs from spout 3' in that main interaction unit 34 comprises at least a third interaction element 56 distinct (and detached) from second interaction element 51, carrying (comprising) at least a third portion 57 of second engagement surface 37. In particular, third interaction element 56 is angularly displaced from second interaction element 51 with respect to rotation axis E. Even more particular, third interaction element 56 is arranged such that, in use and during a control of lid 9 from the closing configuration to the intermediate configuration, at first third portion 57 engages with main guiding portion 44 and subsequently first portion 52 engages with main guiding portion 44.

Preferentially, third portion 57 and first portion 52 lie within a common plane, in particular being parallel to the second plane.

Preferentially, spout 3" also differs from spout 3' in that main interaction structure 33, in particular cam portion 40, comprises a plurality of spaced-apart support ridges 58, in particular integral with main cam portion 42, configured to support main cam portion 42, in particular for enhancing the mechanical stability of main cam portion 42.

The advantages of spouts 3, 3' and 3" and/or the package-spout assembly 1 according to the present invention will be clear from the foregoing description.

In particular, lid 9 by being connected to coupling ring 8 cannot be separated from the other portions of package-spout assembly 1. This hinders the possibility of littering lid 9.

A further advantage resides in that the operation of lid 9 is intuitive as the opening of package-spout assembly 1 (opening of pouring outlet 6) is to be done by rotation of lid 9 according to a user's experience with known types of spouts.

An even further advantage is to be seen in that the interaction of second engagement surface 37 with guiding surface 38 (and in support also by auxiliary guiding portion 45 and auxiliary cam portion 43) moves lid 9 in the intermediate angular position indicating to the user that it is possible to further move lid 9 to the open angular position.

Another advantage is related to providing also for third interaction element 56 allowing to increase the surface area of the portion of second engagement surface 37 interacting, in use, with main guiding portion 44.

Clearly, changes may be made to spout 3, 3' and 3" and/or package-spout assembly 1 as described herein without, however, departing from the scope of protection as defined in the accompanying claims.

According to an alternative non-limiting embodiment not shown, main interaction unit 34 comprises only first interaction element 50 and first interaction element 50 carries (comprises) both first engagement surface 35 and second engagement surface 37. Furthermore, cam portion 40 only comprises auxiliary cam portion 43.

According to an alternative non-limiting embodiment not shown, main interaction unit 34 comprises also third interaction element 56.

The invention claimed is:

1. A spout for a container, in particular a sealed package, filled with a pourable product;

the spout comprises at least:

a collar having a pouring outlet configured to allow an out-pouring of the pourable product; and a lid assembly having a coupling ring rotatably arranged around the collar and a lid hinged to the coupling ring and angularly movable around a respective hinge axis;

wherein the lid is controllable between at least:

a closing configuration in which the lid is in a closing angular position with respect to the hinge axis and in which the lid is configured to cover and/or covers the pouring outlet;

an open configuration in which the lid is in an open angular position with respect to the hinge axis and in which the lid is configured to be detached and/or is detached from the pouring outlet; and an intermediate configuration in which the lid is in an intermediate angular position with respect to the hinge axis interposed between the closing angular position and the open angular position;

wherein the spout comprises an interaction device partially associated to the collar and partially associated to the lid;

wherein the interaction device is configured such that control of the lid from the closing configuration to the intermediate configuration is possible only by rotation of the lid and the coupling ring around a rotation axis and such that control of the lid from the intermediate configuration to the closing configuration is possible by a sole angular movement of the lid around the hinge axis from the intermediate angular position to the closing angular position.

2. The spout according to claim 1, wherein control of the lid from the intermediate configuration to the closing configuration is selectively possible by the sole angular movement of the lid around the hinge axis and by rotation of the lid and the coupling ring around the rotation axis.

3. The spout according to claim 1, wherein the interaction device comprises at least a main interaction structure associated to the collar and a main interaction unit associated to the lid and configured to interact with the main interaction structure;

wherein the main interaction unit comprises:

a first engagement surface configured to abut against an abutment surface of the main interaction structure so as to hinder an angular movement of the lid around the hinge axis and from the closing angular position to the intermediate angular position; and a second engagement surface configured to slide along a guiding surface of the main interaction structure so as to control an angular movement of the lid around the hinge axis and from the closing angular position to the intermediate angular position.

4. The spout according to claim 3, wherein the first engagement surface and the second engagement surface are configured to interact with respectively the abutment surface and the guiding surface as a function of an angular position of the lid with respect to the rotation axis.

5. The spout according to claim 3, wherein the main interaction structure comprises:

a locking portion, which extends between a first angular lid position and a second angular lid position around a longitudinal axis of the pouring outlet and/or the collar and carries the abutment surface; and a cam portion carrying the guiding surface and extending between a third angular lid position and a fourth angular lid position around the longitudinal axis and interposed between the second angular lid position and the first angular lid position.

6. The spout according to claim 5, wherein the locking portion and/or the abutment surface lies within a plane perpendicular to the longitudinal axis.

7. The spout according to claim 5, wherein the cam portion is inclined with respect to the locking portion.

8. The spout according to claim 5, wherein the guiding surface is opposed to the abutment surface.

9. The spout according to claim 3, wherein the first engagement surface is configured to abut against the abutment surface during rotation of the lid in a rotation direction around the rotation axis between a first angular lid position and a second angular lid position, and the second engagement surface being configured to slide along the guiding surface during rotation of the lid in the rotation direction around the rotation axis between a third angular lid position and a fourth angular lid position, the third angular lid position and a fourth angular lid position being interposed between the second angular lid position and the first angular lid position in the rotation direction.

10. The spout according to claim 3, wherein the lid comprises an inner surface and the collar comprises an outer surface;

wherein the inner surface and the outer surface face one another with the lid being controlled in the closing configuration;

wherein the main interaction structure is connected to the outer surface and the main interaction unit is connected to the inner surface.

11. The spout according to claim 10, wherein the main interaction structure protrudes from the outer surface and/or the main interaction unit protrudes from the inner surface.

12. The spout according to claim 11, wherein the main interaction unit comprises a first interaction element carrying the first engagement surface and a second interaction element carrying at least a first portion of the second engagement surface.

13. The spout according to claim 12, wherein the first interaction element carries a second portion of the second engagement surface;

wherein the guiding surface comprises a main guiding portion and an auxiliary guiding portion;

wherein, in use, the second interaction element is configured to interact with the main guiding portion and the first interaction element is configured to interact with the auxiliary guiding portion.

14. The spout according to claim 12, wherein the main interaction unit comprises a third interaction element distinct from the second interaction element and carrying at least a third portion of the second engagement surface.

15. The spout according to claim 1, wherein the main interaction structure and the main interaction unit are also configured to retain the lid in the intermediate angular position after movement from the closing angular position to the intermediate angular position has been terminated.

16. A package-spout assembly comprising a sealed package, in particular formed from a multilayer packaging material, filled with a pourable product comprising a designated pour outlet surface area and a spout according to claim 1 fitted about the designated pour outlet surface area.

17. A spout for a sealed package filled with a pourable product, the spout comprising:

a collar having a pouring outlet configured to allow an out-pouring of the pourable product;

a lid assembly having a coupling ring rotatably arranged around the collar and a lid hinged to the coupling ring and angularly movable around a hinge axis;

wherein the lid is movable between at least:

a closing configuration in which the lid is in a closing angular position with respect to the hinge axis and in which the lid covers the pouring outlet;

an open configuration in which the lid is in an open angular position with respect to the hinge axis and in which the lid is detached from the pouring outlet; and an intermediate configuration in which the lid is in an intermediate angular position with respect to the hinge axis interposed between the closing angular position and the open angular position;

a main interaction structure on the collar and a main interaction unit on the lid that interact with one another such that control of the lid from the closing configuration to the intermediate configuration is possible only by rotation of the lid and the coupling ring around a rotation axis and such that control of the lid from the intermediate configuration to the closing configuration is possible by a sole angular movement of the lid around the hinge axis from the intermediate angular position to the closing angular position;

the main interaction structure on the collar including an abutment surface on the collar and a guiding surface on the collar, the guiding surface being different from the abutment surface;

the main interaction unit on the lid including a first engagement surface on the lid that is configured to abut against the abutment surface during rotation of the lid in a rotational direction around the rotation axis between a first angular lid position and a second angular lid position so that as the first engagement surface abuts against the abutment surface during the rotation of the lid between the first and second angular lid positions, angular movement of the lid around the hinge axis from the closing angular position to the intermediate angular position is prevented; and the main interaction unit also including a second engagement surface on the lid that is configured to slide along the guiding surface during rotation of the lid in the rotational direction around the rotation axis between a third angular lid position and a fourth angular lid position so that as the second engagement surface slides along the guiding surface between the third and fourth angular lid positions the lid angularly moves around the hinge axis from the closing angular position to the intermediate angular position, the third angular lid position and the fourth angular lid position being between the second angular lid position and the first angular lid position in the rotation direction.

18. The spout according to claim 17, wherein the pouring outlet is at an upper end of the collar, the abutment surface on the collar facing away from the upper end of the collar, the guiding surface on the collar facing toward the upper end of the collar, the first engagement surface facing towards the upper end of the collar as the lid rotates in the rotational direction from the first angular lid position to the second angular lid position.

19. The spout according to claim 17, wherein the pouring outlet is at an upper end of the collar, the guiding surface of the collar along which the second engagement surface slides between the third and fourth angular lid positions to angularly move the lid around the hinge axis from the closing angular position to the intermediate angular position being a cam, the cam facing towards the upper end of the collar.

20. The spout according to claim 19, wherein the abutment surface against which the first engagement surface abuts during rotation of the lid between the first and second angular lid positions lies in a first plane, the cam being located in a second plane that intersects the first plane.

* * * * *